United States Patent [19]

Winfree, Jr.

[11] 4,079,839

[45] Mar. 21, 1978

[54] FLEXIBLE LOOP CUE HOLDER

[76] Inventor: John W. Winfree, Jr., 1502 S. Virginia St., Hopkinsville, Ky. 42240

[21] Appl. No.: 639,895

[22] Filed: May 19, 1976

[51] Int. Cl.[2] ..... A47F 7/00

[52] U.S. Cl. ..... 211/68; 211/89

[58] Field of Search ..... 248/110, 111, 113, 315, 248/312; 224/5 B, 7 A; 211/68, 66, 89, 60 T; 24/3 M, 11 F, 265 AL

[56] References Cited

U.S. PATENT DOCUMENTS

| | | | |
|---|---|---|---|
| 2,221,801 | 11/1940 | Keppinger | 211/66 UX |
| 2,987,285 | 6/1961 | Andrews | 211/66 X |
| 3,188,130 | 6/1965 | Pietroinicz | 224/7 A UX |

FOREIGN PATENT DOCUMENTS

| | | | |
|---|---|---|---|
| 1,383,396 | 11/1964 | France | 248/315 |
| 49,112 | 4/1889 | Germany | 211/68 |

*Primary Examiner*—J. Franklin Foss
*Attorney, Agent, or Firm*—Harrington A. Lackey

[57] ABSTRACT

A cue holder including an elongated mounting block, to which are secured in a horizontally spaced arrangement, a plurality of flexible loops projecting from the face of the mounting block, and an annular washer surrounding the legs of each loop for slidable movement toward and away from a cue suspended within said loop.

1 Claim, 3 Drawing Figures

FLEXIBLE LOOP CUE HOLDER

SUMMARY OF THE INVENTION

This invention relates to a cue holder, and more particularly to a flexible loop cue holder.

One object of this invention is to provide a cue holder for supporting the cue near the tip end only, in order to freely suspend the cue, so that the weight of the cue will tend to maintain the cue straight while it is being supported.

More specifically, the cue holder made in accordance with this invention includes an elongated wall-mounted block, from the face of which project a plurality of flexible loops. An annular washer having a central opening receives the legs of the loop to permit the washer to slide toward and away from the closed end of the loop in order to tighten and loosen the loop about the tip portion of the cue. The block is mounted at an elevated horizontal position so that each cue may be freely suspended by the corresponding tightened flexible loop.

The cue may be easily released by moving the washer away from the closed end of the loop toward the mounting block to make the loop larger and thereby release the cue.

DESCRIPTION OF THE PREFERRED EMBODIMENT

Figure 1:
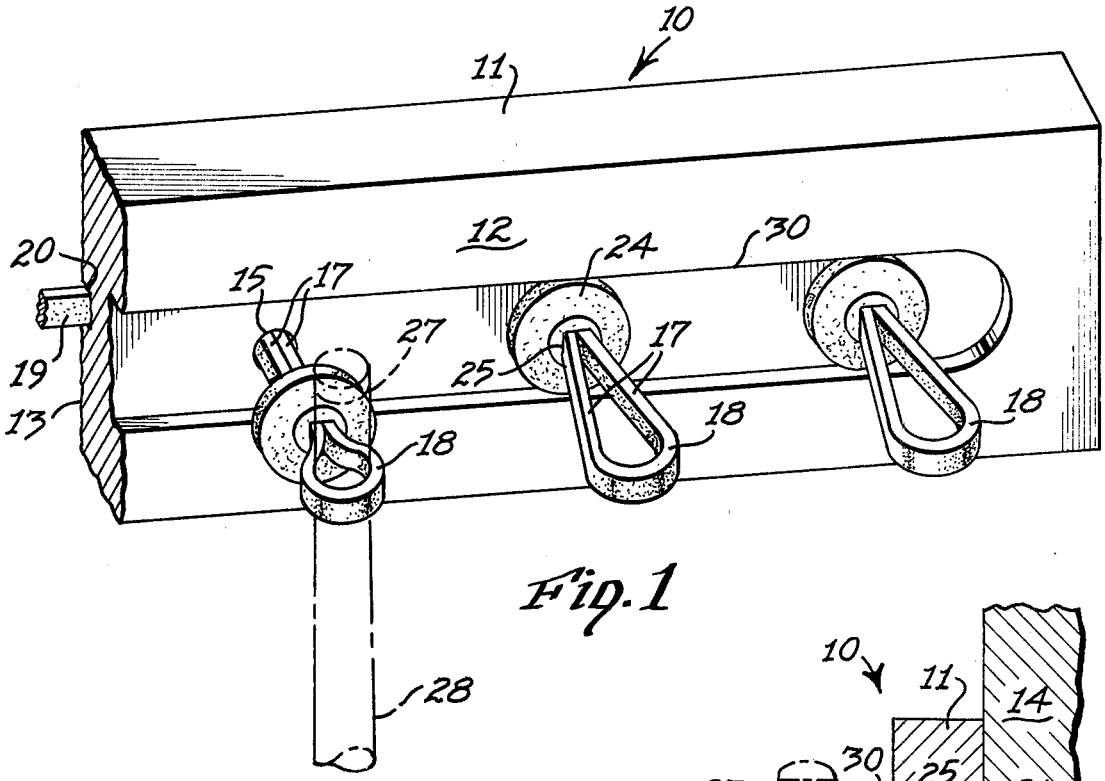
FIG. 1 is a front perspective view of a cue holder made in accordance with this invention, disclosing one of the flexible loops in its operative tightened position supporting a cue and two of the flexible loops in their inoperative positions.

Referring now to the drawings in more detail, the cue holder 10 preferably includes an elongated rectangular mounting block 11, made of any desired material, such as wood, having a front face 12 and a rear face 13 adapted to fit flush against and be fixedly mounted against a wall 14 (FIG. 3), by any desired means, not shown.

Formed at horizontally, and preferably uniformly, spaced intervals along the longitudinal axis of the block 11 are a plurality of holes 15 extending from front to rear through the block 11.

Extending through the holes 15 are the pairs of legs 17 of a plurality of flexible loops 18, which may be formed of any desired flexible linear material, such as rawhide. The loops 18 and their legs 17 are preferably made from a single elongated strip of the flexible material, so that, in fact, the legs 17 of adjacent loops 18 are the same integral connecting piece 19 of flexible material. The single piece of rawhide facilitates the formation of the loops 18 by permitting the single piece to be threaded successively through the holes 15 to form each successive loop 18.

In the preferred form of the invention, elongated grooves 20 are formed along the longitudinal axis in the rear face 13 of the block 11 so that the longitudinal axis of the grooves 20 intersects the centers of the holes 15. The purpose of the grooves 20 is to receive the portions of the legs 17 and the interconnecting portions 19 on the rear face 13, so that the rear surfaces of the legs 17 will be flush with the rear face 13. Thus, the grooves 20 not only provide concealment for the legs 17 and their interconnecting portions 19, but also provide guides for locating the interconnecting portions 19 on the rear face 13. The portions of the legs 17 within the rear grooves 20, or the enlarged portions 21 of the grooves, may be secured in fixed position by fastening elements, such as tacks 22.

Encircling each pair of legs 17 in front of each hole 15 is an annular washer 24, the inner hole 25 of which is adapted to slidably fit around the legs 17 for slidable movement of the washer 24 toward and away from the closed end of the loop 18. In this manner, each washer 24 can be slipped along the leg 17 toward the closed end of the loop 18 in order to tighten the loop 18 about the tip portion 27 of a cue 28 in order to securely grip the cue 28 for free suspension, without the bottom or butt of the cue, not shown, touching the floor or any other object.

Figure 3:
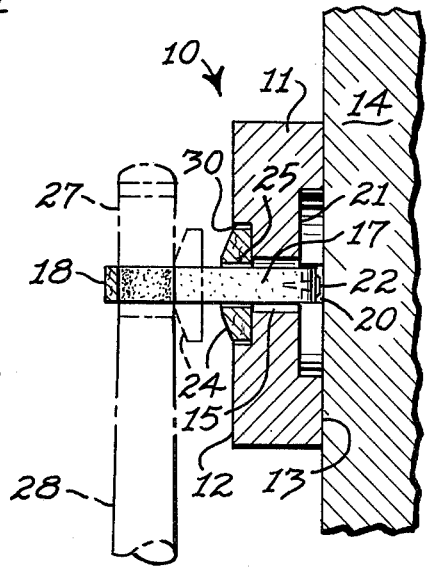
FIG. 3 is a section taken along the line 3—3 of FIG. 2, disclosing the cue holder mounted at an elevated position upon a wall, and disclosing the annular washer in its solid-line inoperative position and in its phantom operative position engaging a cue disclosed fragmentarily in phantom.
Figure 2:
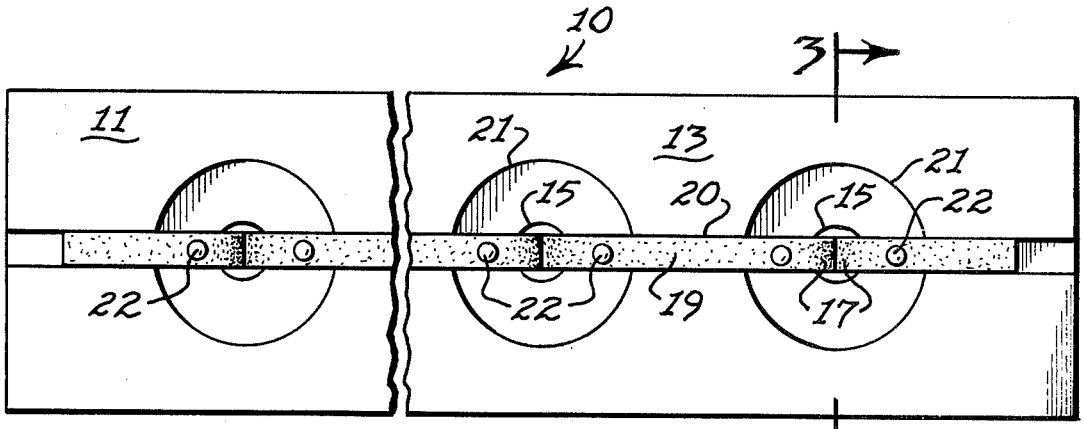
FIG. 2 is a rear elevation of the cue holder disclosed in FIG. 1.

For appearance's sake, the front face 12 of the block 11 may be provided with an elongated recess 30 to receive the annular washers 24 in their retracted inoperative positions as disclosed in FIGS. 1 and 3.

As illustrated in FIG. 1, the loops 18 of flexible material are made to have a substantially larger opening then the diameter of the cue tip portion 27, to enable the cue tip 27 to be easily thrust upward within the opening formed by the open loop 18 when the annular washer 24 is in a withdrawn or retracted position. After the cue 28 is thrust upward so that its tip portion 27 is received within the opening formed by the loop 18, the billiards player may take his other hand and grasp the annular washer 24 and force it forward away from the block 12 and toward the closed end of the loop 18 until the loop 18 is squeezed tightly about the tip portion 27. The washer 24, as well as the cue 28, are released, so that the cue 28 freely hangs with its upper tip portion 27 snugly secured and bound in a suspended position.

The flexible loop 18 must have a surface of a sufficiently high friction that it will securely grip, without slipping, the tip portion 27, and also afford a sufficient frictional fit with the hole 25 of the washer 24 that the washer 24 will be maintained in its operative gripping position, without slipping.

Although only three loops 18 are disclosed in the drawings, nevertheless a cue holder 10 has been built including six loops, and the number of loops 18 is not material to this invention.

When it is desired to release the cue 28, the loop 18 may simply be raised until it does not bind so tightly against the tip portion 27, and the cue 28 then pulled downwardly to slip from the loop 18. The cue 28 may also be released by merely forcing the washer 24 rearward away from the closed end of the loop 18 and removing the cue 28 from the loop 18.

What is claimed is:

1. A holder for a billiards cue comprising:

(a) an elongated mounting block having a longitudinal axis, a front face, and a rear face, (b) a plurality of longitudinally spaced holes extending from front-to-rear through said mounting block, (c) a plurality of closed loops of flexible material having opposed legs, (d) said legs of each loop extending from front-to-rear through each of said holes, so that said closed loop has a diameter, in an open position, larger than the tip portion of a billiards cue received in said loop, (e) elongated grooves in said rear face intersecting and projecting longitudinally and radially away from each of said holes and receiving the legs of said loops projecting rearward from said holes, (f) means securing said legs in said grooves, and (g) an annular washer having a central opening slidably receiving the portions of the legs of each of said flexible loops in front of each hole for movement to a tightening position against the tip portion of a cue received within said closed loop.

* * * * *